US009855644B2

(12) United States Patent
Liu

(10) Patent No.: US 9,855,644 B2
(45) Date of Patent: Jan. 2, 2018

(54) PLIERS

(71) Applicant: COSDA MANUFACTURING COMPANY, Taichung (TW)

(72) Inventor: Lai-Cheng Liu, Taichung (TW)

(73) Assignee: COSDA MANUFACTURING COMPANY, Taichung (TW)

( * ) Notice: Subject to any disclaimer, the term of this patent is extended or adjusted under 35 U.S.C. 154(b) by 0 days.

(21) Appl. No.: 15/433,607

(22) Filed: Feb. 15, 2017

(65) Prior Publication Data

US 2017/0232595 A1 Aug. 17, 2017

(30) Foreign Application Priority Data

Feb. 16, 2016 (TW) ..... 105104467 A

(51) Int. Cl.

| | |
|---|---|
| ***B25B 27/02*** | (2006.01) |
| ***B25B 7/12*** | (2006.01) |
| ***B25B 7/04*** | (2006.01) |
| *B25B 7/00* | (2006.01) |
| *B25B 7/02* | (2006.01) |

(52) U.S. Cl.

CPC ..... *B25B 27/02* (2013.01); *B25B 7/04* (2013.01); *B25B 7/12* (2013.01); *B25B 7/00* (2013.01); *B25B 7/02* (2013.01)

(58) Field of Classification Search

CPC .. B25B 27/02; B25B 7/04; B25B 7/12; B25B 7/00; B25B 7/02; B25B 7/10; B23K 37/0426; A61B 17/2812

See application file for complete search history.

(56) References Cited

U.S. PATENT DOCUMENTS 1,094,269 A * 4/1914 Taylor ..... A61C 3/16 433/154
1,328,423 A * 1/1920 Llewellyn Davies ..... B65B 13/025 140/121
2,328,271 A * 8/1943 Greene ..... B25B 7/02 269/6
3,130,484 A * 4/1964 Zdanis ..... H01R 43/00 140/123
3,263,535 A * 8/1966 Erwin Zurcher ..... B25B 5/06 269/156
3,390,561 A * 7/1968 Finck, Jr. ..... E05B 19/20 29/268

(Continued)

FOREIGN PATENT DOCUMENTS

TW M464286 U 11/2013

*Primary Examiner* — Larry E Waggle, Jr.
*Assistant Examiner* — Danny Hong
(74) *Attorney, Agent, or Firm* — Muncy, Geissler, Olds & Lowe, P.C.

(57) ABSTRACT

A pliers is provided, including a first clamping body and a second clamping body. The first clamping body has two first jaw portions and two first gripping portions, and the two first jaw portions are associated respectively with the two first gripping portions and are capable of being open or closed relative to each other. The second clamping body has a clamping jaw and a second gripping portion, the second clamping body and the first clamping body are pivotally connected to each other at a location between the clamping jaw and the second gripping portion, and the clamping jaw and the two first jaw portions are capable of being open or closed relative to each other.

9 Claims, 7 Drawing Sheets

(56) References Cited

U.S. PATENT DOCUMENTS

| | | | | | |
|---|---|---|---|---|---|
| 3,688,380 | A * | 9/1972 | Hofmann | B25B 27/0078 | 29/243.56 |
| 3,825,990 | A * | 7/1974 | Shields | A61B 17/3217 | 29/268 |
| 3,969,964 | A * | 7/1976 | George | B25B 7/00 | 29/268 |
| 5,092,074 | A * | 3/1992 | Zincke | A01K 97/00 | 43/53.5 |
| 5,327,802 | A * | 7/1994 | Yu | B25B 7/04 | 29/229 |
| 7,581,949 | B2 * | 9/2009 | Farzin-Nia | A61C 7/02 | 140/106 |
| 8,628,070 | B2 * | 1/2014 | Neubauer | B25B 5/003 | 269/143 |

* cited by examiner

PLIERS

BACKGROUND OF THE INVENTION

Field of the Invention

The present invention relates to a pliers, and more particularly to a pliers which is used to separate two tube members connected with each other.

Description of the Prior Art

In a pipeline transferring fluids (for example, machine oil or gas), two different kinds of tube members are inserted into and connected with each other, at least one of the two tube members is made of a soft plastic so that the tube member is bendable according to different requirements, and the whole pipeline can extend to an assembly or a position a user wants. When separating two tube members, the user often use both hands to respectively grasp the two tube members and pull the two tube members apart toward opposite directions. Sometimes, in order to prevent hands from getting dirty or harmed (for example, burnt), the user often uses a pliers to clamp the tube members and separate the tube members. This type of pliers is disclosed in TWM464286.

However, in the prior art, a connection place between the two tube members is easy to stick together because of oxidation, and it is difficult to separate the two tube members. If the user pulls the two tube members hardly when the two tube members stick together, the tube members may be deformed and damaged and cannot be use again.

The present invention has arisen to mitigate and/or obviate the afore-described disadvantages.

SUMMARY OF THE INVENTION

The major object of the present invention is to provide a pliers, which can positionably and firmly clamp one of two tube members, drives the other of the two tube members to move relatively via a clamping jaw and further separate the two tube members; and during a separation process, a structural integrity of the two tube members can be maintained, and the two tube members can be used again.

To achieve the above and other objects, a pliers is provided, including a first clamping body and a second clamping body. The first clamping body has two first jaw portions and two first gripping portions, and the two first jaw portions are associated respectively with the two first gripping portions and are capable of being open or closed relative to each other. The second clamping body has a clamping jaw and a second gripping portion, the second clamping body and the first clamping body are pivotally connected to each other at a location between the clamping jaw and the second gripping portion, and the clamping jaw and the two first jaw portions are capable of being open or closed relative to each other.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
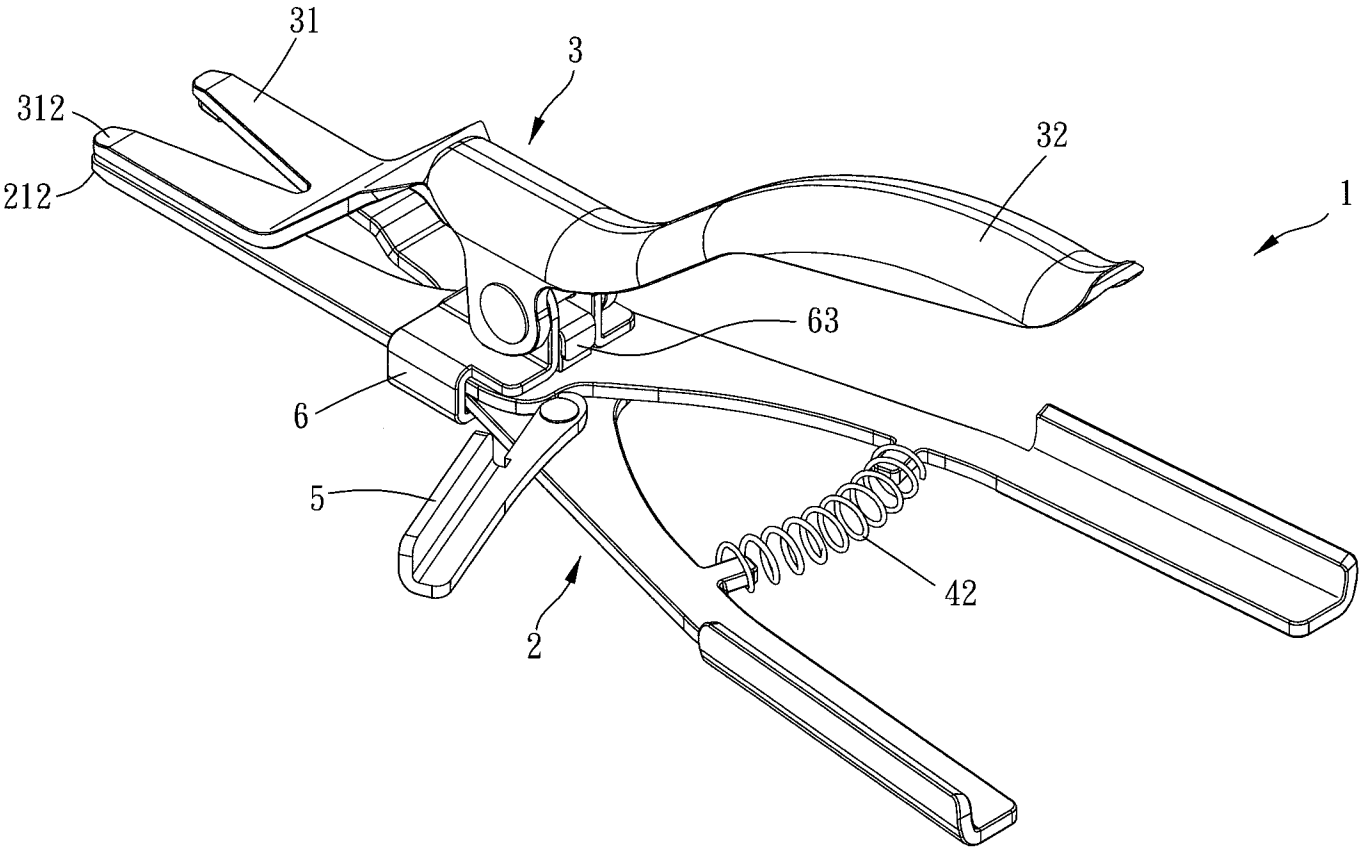
FIG. 1 is a stereogram of a preferred embodiment of the present invention.
Figure 2:
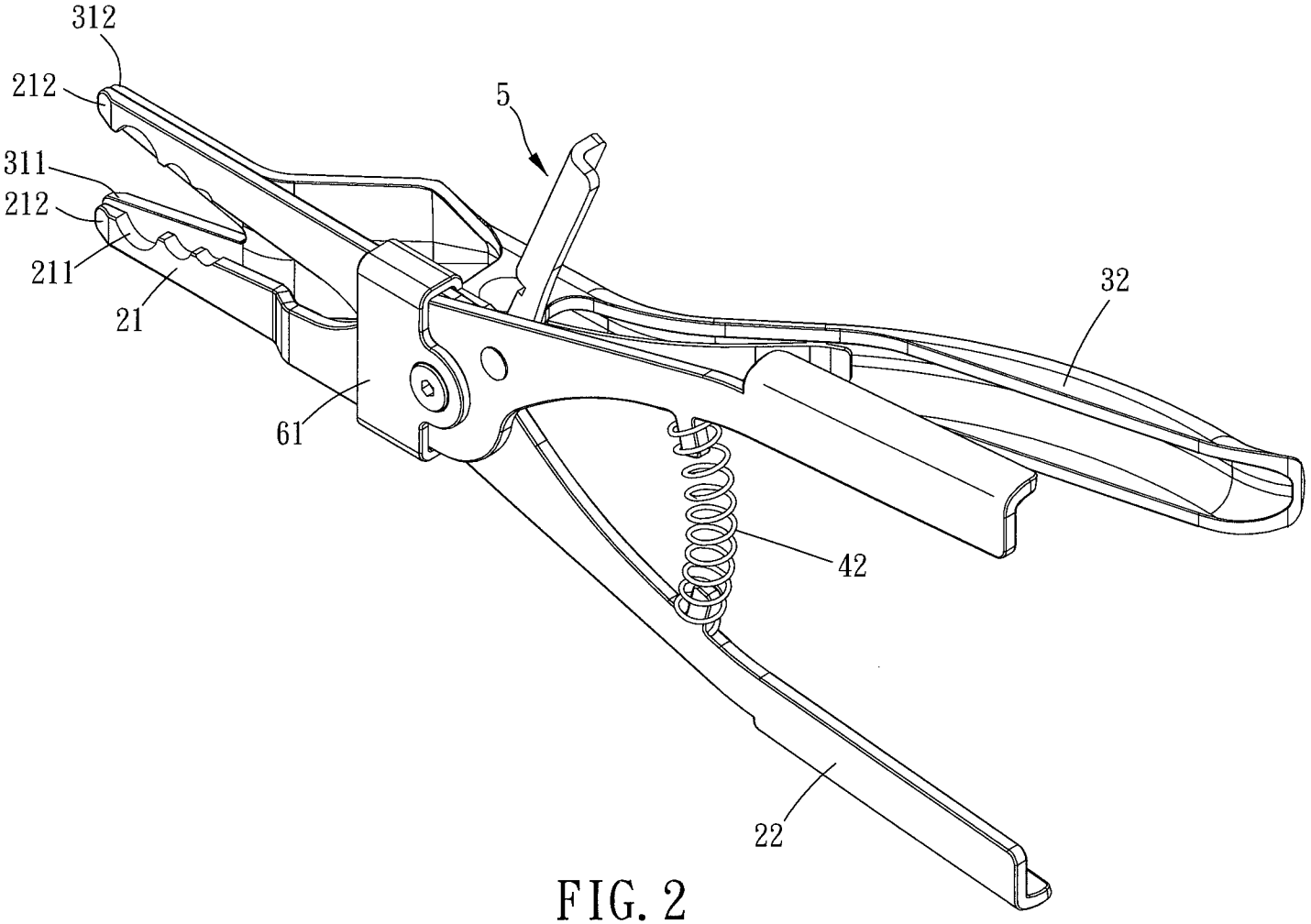
FIG. 2 is another stereogram of the preferred embodiment of the present invention.
Figure 3:
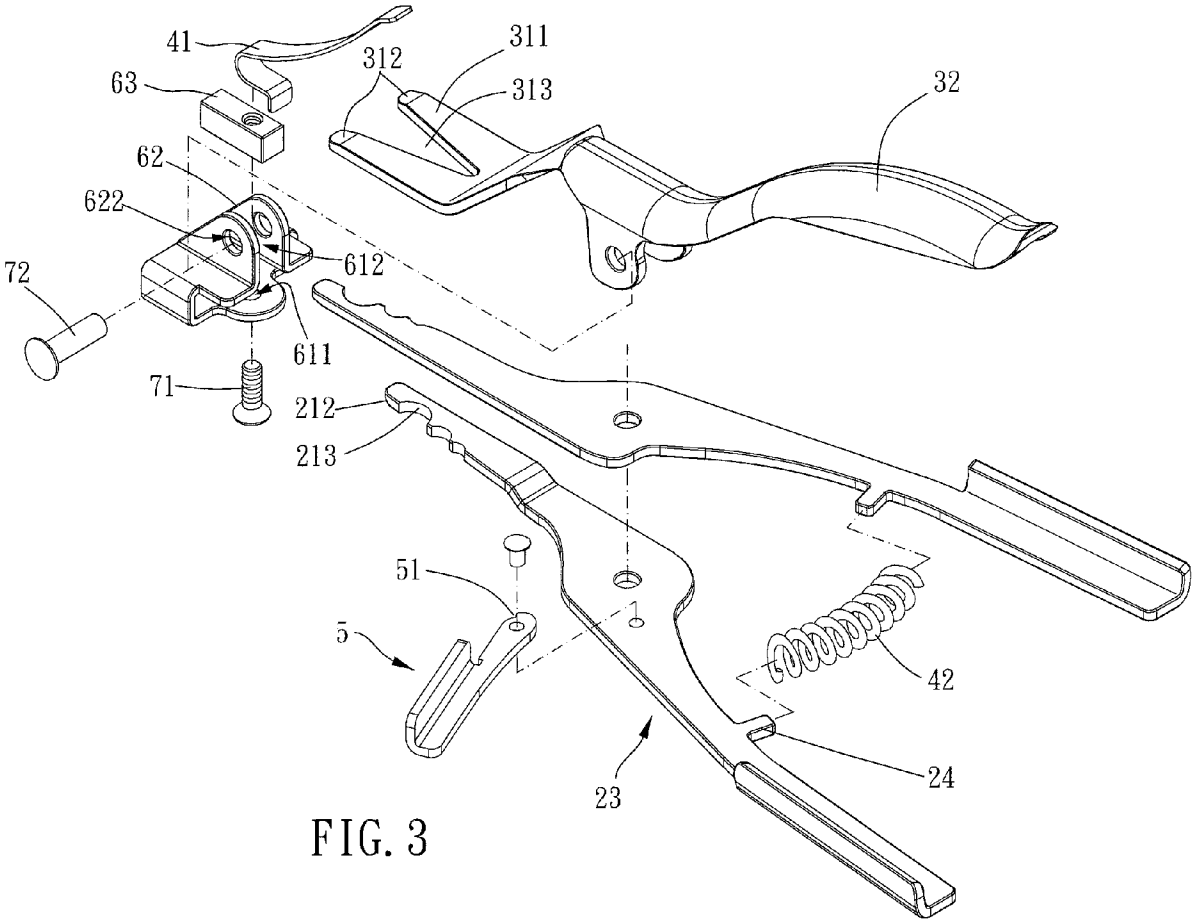
FIG. 3 is a breakdown view of the preferred embodiment of the present invention.
Figure 4:
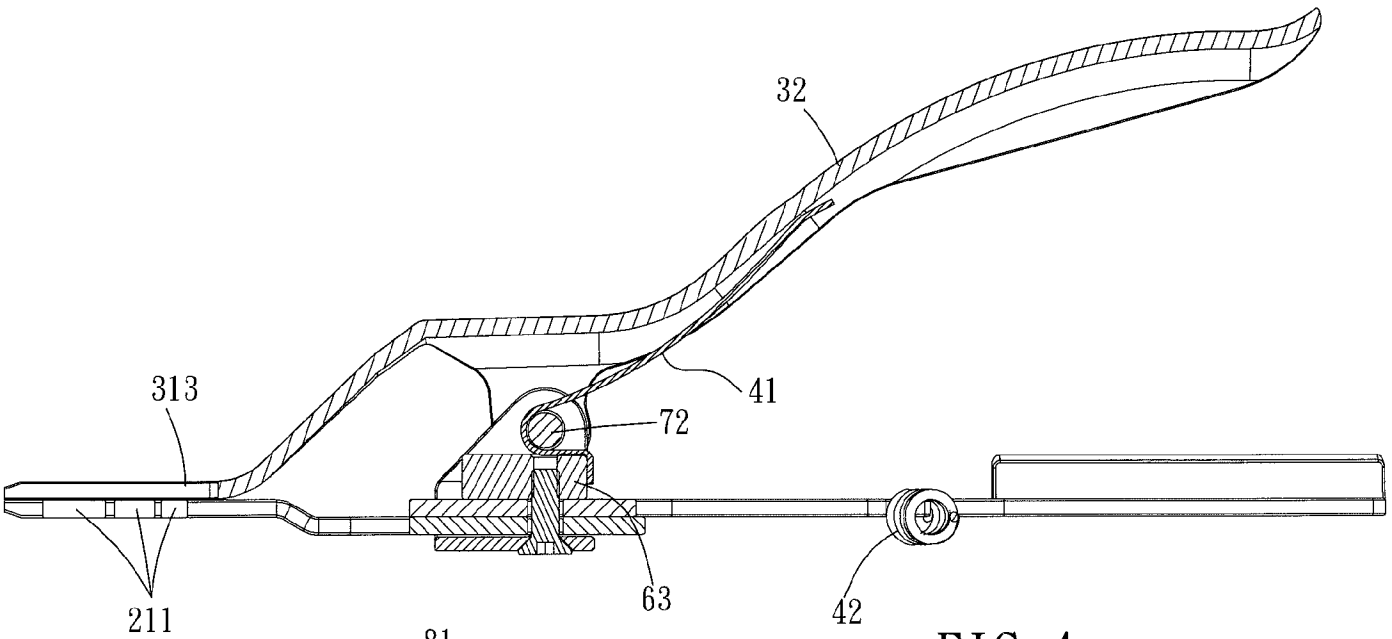
FIG. 4 is a cross-sectional front view of FIG. 1.
Figure 5:
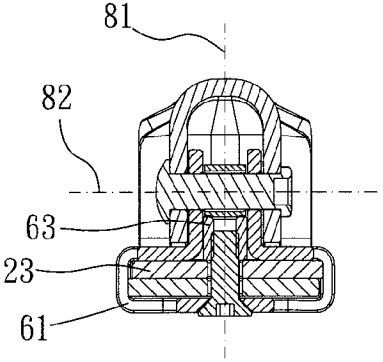
FIG. 5 is a cross-sectional left view of FIG. 1.

The present invention will be clearer from the following description when viewed together with the accompanying drawings, which show, for purpose of illustrations only, the preferred embodiment in accordance with the present invention.

Please refer to FIGS. 1 to 8 for a preferred embodiment of the present invention. A pliers 1 includes a first clamping body 2 and a second clamping body 3.

The first clamping body 2 has two first jaw portions 21 and two first gripping portions 22, and the two first jaw portions 21 are associated respectively with the two first gripping portions 22 and are capable of being open or closed relative to each other. The second clamping body 3 has a clamping jaw 31 and a second gripping portion 32, the second clamping body 3 and the first clamping body 2 are pivotally connected to each other at a location between the clamping jaw 31 and the second gripping portion 32, and the clamping jaw 31 and the two first jaw portions 21 are capable of being open or closed relative to each other.

Figure 6:
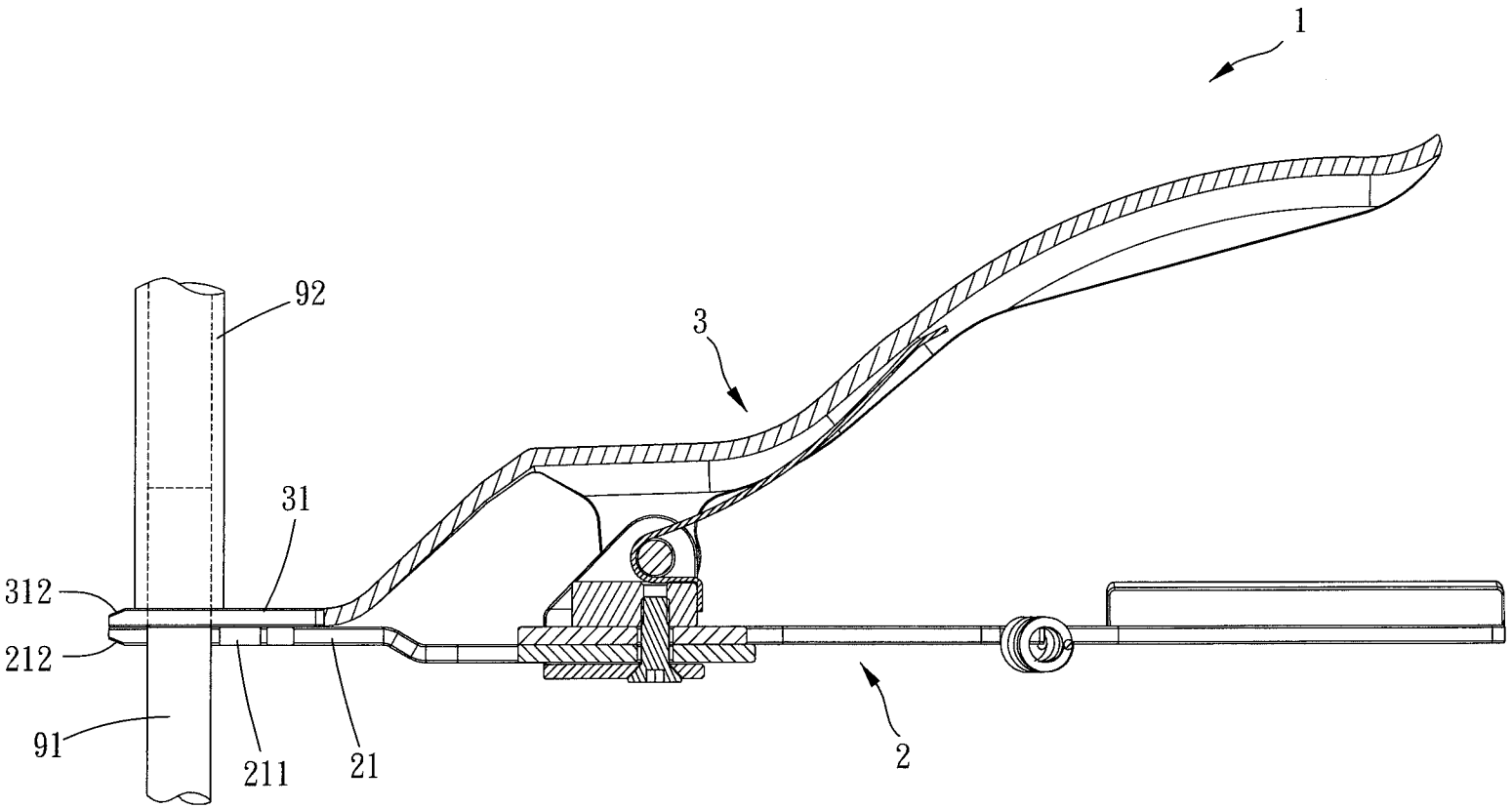
FIGS. 6 and 7 are drawings showing operation of the preferred embodiment of the present invention.
Figure 7:
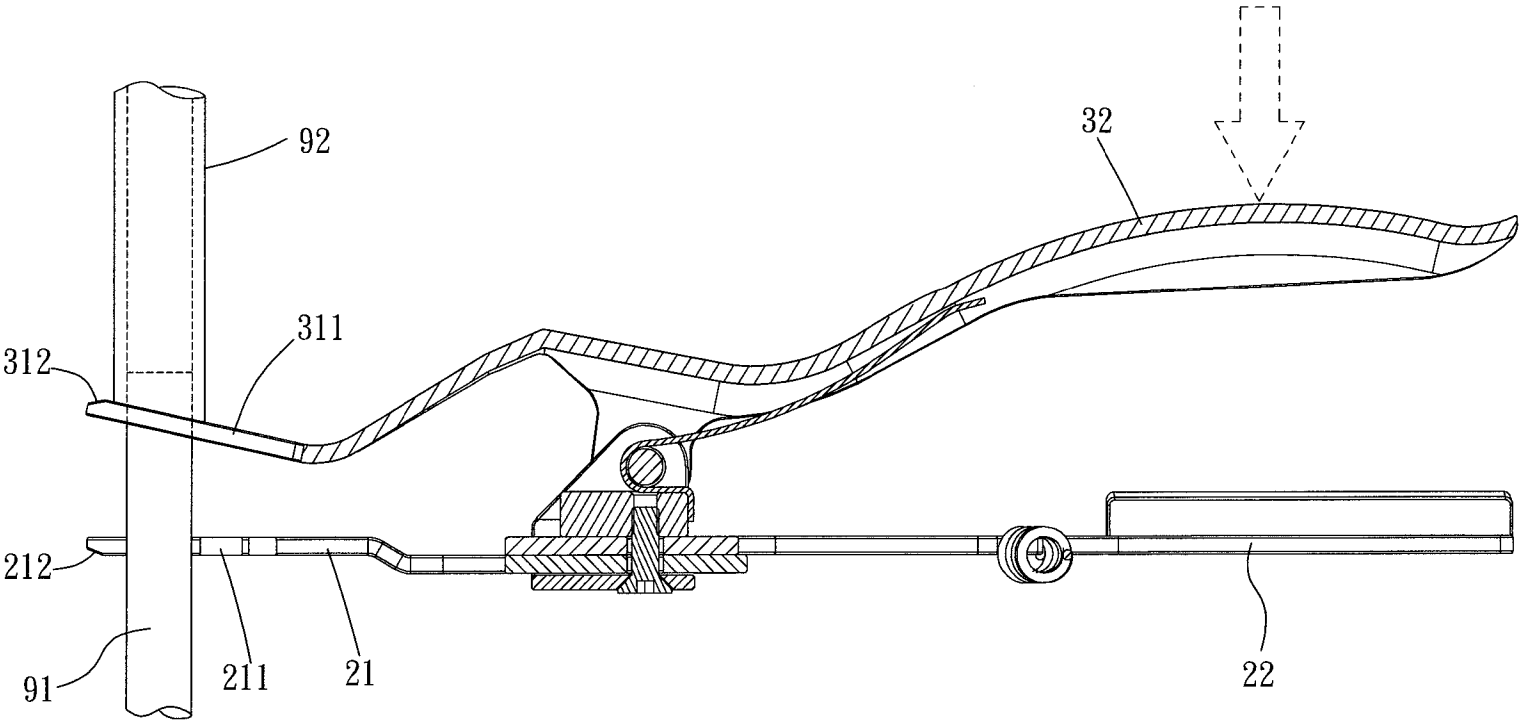
Figure 8:
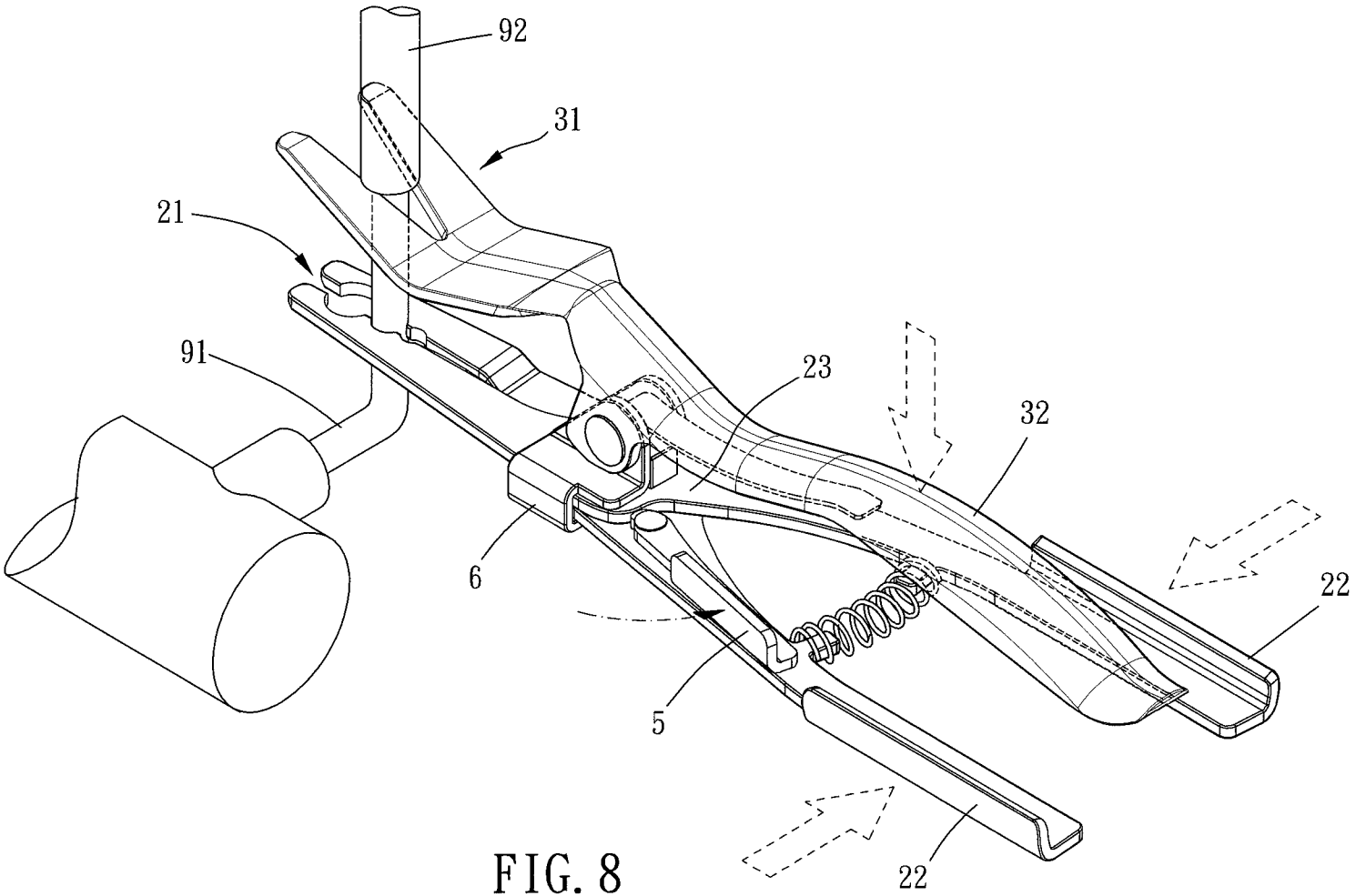
FIG. 8 is a drawing showing operation of separating two tube members connected with each other according to the preferred embodiment of the present invention.

Please further refer to FIGS. 6 to 8 for a detailed illustration of movements of the pliers 1 in operation. When a user wants to separate a first tube member 91 and a second tube member 92, s/he needs to use the two first jaw portions 21 and the clamping jaw 31 to clap the first tube member 91 and a place near the second tube member 92 (as shown in FIG. 6), and the clamping jaw 31 is located between the two first jaw portions 21 and the second tube member 92. Then, the two first gripping portions 22 are actuated (for example, pressed) to drive the two first jaw portions 21 to clamp the first tube member 91 tightly. Finally, the second gripping portion 32 is pressed to drive the clamping jaw 31 to push the second tube member 92 to move away from the two first jaw portions 21 (as shown in FIG. 7). Through the above steps, it is quick and convenient to separate the first and second tube members 91, 92. In addition, the first and second tube members 91, 92 will not be deformed or damaged due to overexertion, and the first and second tube members 91, 92 can be used again; and hands of the user will not get dirty or harmed (for example, burnt).

In this embodiment, the clamping jaw 31 includes two second jaw portions 311 which are fixedly connected to each other, as viewed along an opening and closing direction of the clamping jaw 31 and the two first jaw portions 21, the two second jaw portions 311 are in a V shape, and the two first jaw portions 21 are in a V shape when the pliers 1 is in an opening state; therefore, a position of the second jaw portions 311 can be adjusted in accordance with tubes in different diameters so as to clamp the tube firmly. In other embodiments, the second clamping body may be designed as the first clamping body 2 (two second jaw portions co-move with two second gripping portions) so that the second clamping body can clamp the second tube member 92.

Preferably, the two first jaw portions 21 may respectively have a plurality of recesses 211 in different dimensions and correspondingly arranged, the recesses 211 receive a part of the tube member so as to increase a clamping stability and prevent the two first jaw portions 21 from sliding when clamping. More preferably, the pliers 1 further includes a positioning assembly 5, and the positioning assembly 5 optionally positions a relative position of the two first gripping portions 22. Specifically, the two first jaw portions 21 respectively have the plurality of recesses 211 being in different depths and in opening spans, and each recess 211 has an inner surface 213 which is arcuately smooth. The two second jaw portions 311 form a notch 313 therebetween. As viewed along the opening and closing direction of the clamping jaw 31 and the two first jaw portions 21, two ends of the notch 313 extend beyond the plurality of recesses 211 in a longitudinal direction of the first jaw portion 21.

Specifically, two clamping members 23 are pivoted to each other to form the first clamping body 2, the two clamping members 23 are swingable relative to each other, two ends of each said clamping member 23 respectively have the first jaw portion 21 and the first gripping portion 22, and the positioning assembly 5 optionally interferes with a swinging movement of the two clamping members 23 and the relative position of the two first gripping portions 22. More specially, the positioning assembly 5 is pivoted to one of the two clamping members 23 and has a blocking portion 51, the positioning assembly 5 is for being operated from outside to move between a releasing position and a locking position. When the positioning assembly 5 is in the releasing position, the blocking portion 51 is out of a swinging path of the other of the two clamping members 23; and when the positioning assembly 5 is in the locking position, the blocking portion 51 is on the swinging path of the other of the two clamping members 23 and abuts against the clamping member 23 (as shown in FIG. 8).

It is to be noted that an outer contour of the blocking portion 51 is continuously curved, and the blocking portion 51 is steplessly and positionably abuts against the clamping member 23. In other embodiments, the outer contour of the blocking portion may be designed as tooth-shaped, and an outer contour of the clamping member may be a tooth shape corresponding to the outer contour of the blocking portion so as to positionably mesh with each other.

The pliers 1 further includes a base 6, the base 6 has a main body 61 and two wing portions 62 corresponding to each other, each said wing portion 62 extends laterally from a side of the main body 61, and the main body 61 has a receiving space 612 and a first pivotal hole 611. Specifically, two clamping members 23 are crossly pivoted to each other to form the first clamping body 2, the two clamping members 23 are disposed through the receiving space 612, a first pivotal axle 71 is disposed through the first pivotal hole 611 and the two clamping members 23 along a first direction 81 to be engaged with a fixing member 63, the two clamping members 23 are located between the main body 61 and the fixing member 63, and the two clamping members 23 are swingable relative to each other about the first pivotal axle 71. When the two first jaw portions 21 have a greatest distance therebetween, the two clamping members 23 respectively abut against the main body 61 laterally. It is understandable that each said wing portion 62 has a second pivotal hole 622, a second pivotal axle 72 is disposed through the two second pivotal holes 622 and the second clamping body 3 along a second direction 82, and the second direction 82 is perpendicular to the first direction 81.

In addition, more specifically, as viewed along a direction perpendicular to the first and second directions 81, 82, the receiving space 612 is reverse T-shaped, and the fixing member 63 is arranged in a middle section of the receiving space 612. As viewed along the first direction 81, the two gripping portions 32 are located between the two clamping members 23; and as viewed along the second direction 82, each said second jaw portion 311 and the second gripping portion 32 are respectively r-shaped. More specifically, each said first jaw portion 21 further has a first slanting portion 212, each said second jaw portion 311 further has a second slanting portion 312, and the first and second slanting portions 212, 312 extend and approach relative to each other to form a tip for entering gaps or other narrow spaces. In addition, each said clamping member 23 is divided into the first jaw portion 21 and the first gripping portion 22 via the first pivotal axle 71, and on the direction perpendicular to the first and second directions 81, 82, a length proportion of the first jaw portion 21 and the first gripping portion 22 is substantially 7:11 so that it is more energy-saving for the user to press the two first gripping portions 22. Similarly, the second clamping body 3 may have the same design.

Furthermore, in this embodiment, a first elastic member 41 is arranged between the first clamping body 2 and the second clamping body 3, and the first elastic member 41 makes the two first jaw portions 21 and the clamping jaw 31 have a tendency to approach and contact each other so as to clamp the tube member simultaneously and prevent the two first jaw portions 21 and the clamping jaw 31 from moving randomly during operation. One of two ends of the first elastic member 41 is arranged around a part of the second pivotal axle 72 and abuts against the fixing member 63, and the other of the two ends of the first elastic member 41 abuts against the second clamping body 3. A second elastic member 42 is arranged between the two first gripping portions 22, and the second elastic member 42 makes the two first gripping portions 22 have a tendency to move away from each other. Each said first gripping portion 22 has an inserting member 24, and two ends of the second elastic member 42 are respectively and positionably sleeved on the two inserting members 24. It is to be emphasized that the first and second elastic members are designed based on operation habits and convenience, so the user can operate the pliers 1 to open or closed with a hand.

Given the above, in the pliers of the present invention, the first clamping body can firmly position the first tube member, and the clamping jaw of the second clamping body can push and drive the second tube member to move away from the first tube member relatively so as to separate the two tube members. In other words, the pliers of the present invention can be opened or closed in two directions. In addition, through the structure of the pliers, the first and second tube members can be separated while maintaining the structural integrity, and the first and second tube members will not be deformed or damaged. Furthermore, the operation process is convenient and quick, and the user only needs to operate with a hand.

While we have shown and described various embodiments in accordance with the present invention, it should be clear to those skilled in the art that further embodiments may be made without departing from the scope of the present invention.

What is claimed is:

1. A pliers, including:

a first clamping body, having two first jaw portions and two first gripping portions, the two first jaw portions associated respectively with the two first gripping portions and capable of being open or closed relative to each other;

a second clamping body, having a clamping jaw and a second gripping portion, the second clamping body and the first clamping body pivotally connected to each other at a location between the clamping jaw and the second gripping portion, the clamping jaw and the two first jaw portions capable of being open or closed relative to each other;

wherein the two first jaw portions respectively have a plurality of recesses correspondingly arranged and being in different depths and in opening spans, and each recess has an inner surface which is arcuately smooth;

wherein the clamping jaw includes two second jaw portions which are fixedly connected to each other, the two second jaw portions are in a V shape and form a notch therebetween; and wherein as viewed along an opening and closing direction of the clamping jaw and the two first jaw portions, two ends of the notch extend beyond the plurality of recesses in a longitudinal direction of the first jaw portion.

2. The pliers of claim 1, wherein a first elastic member is arranged between the first clamping body and the second clamping body, and the first elastic member makes the two first jaw portions and the clamping jaw have a tendency to approach and contact each other.

3. The pliers of claim 1, wherein a second elastic member is arranged between the two first gripping portions, and the second elastic member makes the two first gripping portions have a tendency to move away from each other.

4. The pliers of claim 1, wherein as viewed along an opening and closing direction of the clamping jaw and the two first jaw portions, the two first jaw portions are in a V shape when the pliers is in an opening state.

5. The pliers of claim 1, further including a positioning assembly, the positioning assembly optionally positioning a relative position of the two first gripping portions.

6. The pliers of claim 5, wherein two clamping members are pivoted to each other to form the first clamping body, the two clamping members are swingable relative to each other, two ends of each said clamping member respectively have the first jaw portion and the first gripping portion, and the positioning assembly optionally interferes with a swinging movement of the two clamping members and the relative position of the two first gripping portions.

7. The pliers of claim 6, wherein the positioning assembly is pivoted to one of the two clamping members and has a blocking portion, the positioning assembly is for being operated from outside to move between a releasing position and a locking position; wherein when the positioning assembly is in the releasing position, the blocking portion is out of a swinging path of the other of the two clamping members; and when the positioning assembly is in the locking position, the blocking portion is on the swinging path of the other of the two clamping members and abuts against the clamping member.

8. The pliers of claim 1, further including a base, the base having a main body and two wing portions corresponding to each other, each said wing portion extending laterally from a side of the main body, the main body having a receiving space and a first pivotal hole, two clamping members being crossly pivoted to each other to form the first clamping body, the two clamping members being disposed through the receiving space, a first pivotal axle being disposed through the first pivotal hole and the two clamping members along a first direction to be engaged with a fixing member, the two clamping members being located between the main body and the fixing member, the two clamping members being swingable relative to each other about the first pivotal axle, each said wing portion having a second pivotal hole, a second pivotal axle being disposed through the two second pivotal holes and the second clamping body along a second direction, the second direction being perpendicular to the first direction.

9. The pliers of claim 8, wherein as viewed along a direction perpendicular to the first and second directions, the receiving space is reverse T-shaped, and the fixing member is arranged in a middle section of the receiving space; each said clamping member is divided into the first jaw portion and the first gripping portion via the first pivotal axle, and on the direction perpendicular to the first and second directions, a length proportion of the first jaw portion and the first gripping portion is substantially 7:11; when the two first jaw portions have a greatest distance therebetween, the two clamping members respectively abut against the main body laterally; a first elastic member is arranged between the first clamping body and the second clamping body, and the first elastic member makes the two first jaw portions and the clamping jaw have a tendency to approach and contact each other; one of two ends of the first elastic member is arranged around a part of the second pivotal axle and abuts against the fixing member, and the other of the two ends of the first elastic member abuts against the second clamping body; a second elastic member is arranged between the two first gripping portions, and the second elastic member makes the two first gripping portions have a tendency to move away from each other; each said first gripping portion has an inserting member, and two ends of the second elastic member are respectively and positionably sleeved on the two inserting members; as viewed along an opening and closing direction of the clamping jaw and the two first jaw portions, the two first jaw portions are in a V shape when the pliers is in an opening state; each said first jaw portion further has a first slanting portion, each said second jaw portion further has a second slanting portion, and the first and second slanting portions extend and approach relative to each other; as viewed along the second direction, each said second jaw portion and the second gripping portion are respectively r-shaped, and as viewed along the first direction, the second gripping portion is located between the two clamping portions; the pliers further includes a positioning assembly, the positioning assembly optionally positions a relative position of the two first gripping portions, and the positioning assembly optionally interferes with a swinging movement of the two clamping members and the relative position of the two first gripping portions; two ends of each said clamping member respectively have the first jaw portion and the first gripping portion; the positioning assembly is pivoted to one of the two clamping members and has a blocking portion, and the positioning assembly is for being operated from outside to move between a releasing position and a locking position; when the positioning assembly is in the releasing position, the blocking portion is out of a swinging path of the other of the two clamping members; and when the positioning assembly is in the locking position, the blocking portion is on the swinging path of the other of the two clamping members and abuts against the clamping member, an outer contour of the blocking portion is continuously curved, and the blocking portion is steplessly and positionably abuts against the clamping member.

* * * * *